US008292837B2

(12) United States Patent
Du

(10) Patent No.: US 8,292,837 B2
(45) Date of Patent: Oct. 23, 2012

(54) COMBINATION EXERCISE-MASSAGE DEVICE

(76) Inventor: Tiffany Du, Garden Grove, CA (US)

( * ) Notice: Subject to any disclaimer, the term of this patent is extended or adjusted under 35 U.S.C. 154(b) by 357 days.

(21) Appl. No.: 12/730,809

(22) Filed: Mar. 24, 2010

(65) Prior Publication Data

US 2011/0237987 A1 Sep. 29, 2011

(51) Int. Cl.
*A61H 1/00* (2006.01)

(52) U.S. Cl. ..... 601/24; 482/97; 482/137; 482/142

(58) Field of Classification Search ..... 601/23–24, 601/26, 28–29, 49, 51–54, 89–90, 100, 115–116, 601/122, 126–128; 29/428; 482/97, 136–137, 482/142

See application file for complete search history.

(56) References Cited

U.S. PATENT DOCUMENTS 4,678,185 A * 7/1987 Mahnke ..... 482/137
4,696,469 A * 9/1987 Elder ..... 482/137
5,772,614 A * 6/1998 Lindquist ..... 601/116
6,390,997 B1 * 5/2002 Vitko ..... 601/115
6,814,708 B1 * 11/2004 Jennings ..... 601/24
7,004,891 B2 * 2/2006 Morris et al. ..... 482/101
7,052,448 B2 * 5/2006 Teeter ..... 482/144
7,121,985 B2 * 10/2006 Cheng ..... 482/57
7,276,033 B2 * 10/2007 Phillips ..... 601/23
2001/0039390 A1 * 11/2001 Barrett ..... 601/90
2005/0202936 A1 * 9/2005 Ota ..... 482/54
2008/0300115 A1 * 12/2008 Erlandson ..... 482/54
2010/0210978 A1 * 8/2010 Oddsson ..... 601/24

* cited by examiner

*Primary Examiner* — Quynh-Nhu H Vu
(74) *Attorney, Agent, or Firm* — Richard D. Clarke

(57) ABSTRACT

The present application describes a combination exercise-massage unit consisting of a base platform with enclosed weight enclosure at one end and a pivoting bed assembly at the other. The bed assembly can easily be tipped having the effect of increasing the weight lifted, reducing the pressure of the rollers on the back or relieving tension by elevating the head. A continuous belt covers a plurality of massage rollers that have replaceable outer sleeves with a variety of different configurations and softness. There is a translating framework that has elevated head rest and two shoulder supports on either side. The person can hold the upright handles or the side support bars with the padded side members of the translating framework. The translating framework can be adjusted in length to accommodate the height of the person using the unit.

20 Claims, 11 Drawing Sheets

COMBINATION EXERCISE-MASSAGE DEVICE

FIELD OF THE INVENTION

This application is directed to the field of a unique leg exercise device that incorporate a feature that will automatically massage the back of an individual in the process of doing leg exercises.

BACKGROUND OF THE INVENTION

Fully 80 percent of Americans suffer, off and on, from backaches. So common are they that people often assume that they are inevitable, especially as you get older. But doctors say this is not so. Although old age and congenital defects account for some backaches, most result from muscular weakness due to a sedentary existence and stress. When people tense up under stress, their flabby, unprepared muscles go into spasm. The pain of these spasms may be so agonizing that the individual is sure something in the spine must have slipped or possibly broken, but actually cases in which this occurs only account for about 5 to 10 percent of backache problems. The commonest of back difficulties is low back pain where an acute spasm of one of the powerful muscles running along the lower spine occurs, putting pressure on one or more nerves.

Historically, the creation of many devices has been attempted for the purpose of either strengthening the back or for the mere purpose of administering a good massage. Some inventions were meant to produce only local stimulation of trigger points within the muscles. A few devices have been somewhat successful in performing multiple functions with limited success, but they do not achieve the localized massage capability along with the exercise as does the Combination Exercise-Massage Unit. Often the cost of manufacture of these devices has been prohibitive to widespread use. The combination of exercising the legs while the back is being massaged has multiple benefits that will be disclosed within this application.

Numerous innovations for exercise and massage devices have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Combination Exercise-Massage Unit and the prior art.

U.S. Pat. No. 5,772,614 of Edward E. Lindquist describes a back massage and exercise device comprising a substantially flat, elongate frame able to be utilized on a supporting surface, with the frame having a pair of long sides joined together by a pair of short sides and being several times as long as it is wide. A roller array in the form of a parallel series of elongate rollers is loosely mounted in a spaced apart, operational relationship between the long sides of the frame. The frame has an operative position in which a lower portion of substantially all of the rollers is in contact with the supporting surface, with an upper portion of the rollers being available for directly supporting the body of a user. The user is able to readily bring about back and forth rolling movement of the frame along the supporting surface at such time as he is lying on the rollers, with the motion of the upper portions of the rollers during such movement of the frame bringing about a massaging action to the portion of the user's body in contact with the rollers. At least one of the rollers is of significantly larger diameter than the other rollers of the array, with the larger diameter roller operatively mounted so as to be contacted by the user's head. Significantly, the larger diameter roller is employable by the user for head, neck and shoulder massage.

This patent describes a back massage and exercise device having a roller array in the form of a parallel series of elongate rollers that are loosely mounted spaced apart between the long sides of the frame. With this device the user is able to readily bring about back and forth rolling movement of the frame along the supporting surface at such time as he is lying on the rollers, with the motion of the upper portions of the rollers during such movement of the frame bringing about a massaging action to the portion of the user's body in contact with the rollers, where the massage rollers of the Combination Exercise-Massage Unit are stationary and have a variety of different replaceable outer sleeves. The person using the Combination Exercise-Massage Unit moves up and down by the means of a continuous belt over the stationary massage rollers.

U.S. Pat. No. 6,390,997 of David M. Vitko describes a small lightweight yet strong frame housing multiple flexible axles which in turn support foam rubber roller balls, which roll about an axis creating: massage, intersegmental traction, trigger point therapy, and active exercise to the back of the user. These axles are made more efficient by the placement of bushings where they are contained by frame. Foam rubber balls contain sleeves which promote free rotation. A sliding head rest is provided for comfort and is also used to facilitate optional concomitant neck and back treatment and multiple tension adjustments are provided for varying resistance to glide.

This patent describes a small lightweight yet strong frame housing multiple flexible axles which in turn support foam rubber roller balls, which roll about an axis creating massage. With this device the person moves their body up and down by the means of an ankle strap. There is no way to adjust the weight required to produce the up and down movement to increase the exercise involved. It uses foam rubber roller balls instead of the unique massage rollers with replaceable outer sleeves.

U.S. Pat. No. 7,052,448 of Roger C. Teeter describes a tilting inversion exerciser that includes a stand, a table rotatably attached to the stand to support a user, and a carrier slidably received in the table. The carrier includes a massage device for massaging the user. The table includes a bolt rotatably received in a chamber and threaded to the carrier, to move the carrier relative to the table. A motor may be coupled to the bolt, to rotate or drive the bolt to move the carrier relative to the table. One or more cranks are rotatably attached to the carrier and each has one or more wheels for engaging with and for massaging the user. The carrier includes a motor for actuating the wheels to massage the user via the crank.

This patent describes a tilting inversion exerciser with a carrier that includes a massage device for massaging the user. The carrier includes a motor for actuating the wheels to massage the user via the crank. Although this device incorporates a means of tipping the person using the device, it does not incorporate the unique massage rollers with replaceable outer sleeves, and requires an electrical connection and the method of tipping is completely different.

U.S. Pat. No. 7,121,985 of Kao Pin Cheng describes an exercise device that includes a carriage slidably supported on a supporting base for supporting users and having a number of massage members for massaging the users. A moving device may be used to move the carriage relative to the supporting base and thus to move the massage members relative to the users, and to massage the users with the massage members. The moving device includes an eccentric rotary member rotatably attached to the supporting base, and a coupling device coupling the eccentric rotary member to the carriage and to move the carriage relative to the supporting base when the eccentric rotary member is rotated by users.

This patent describes an exercise device that includes a carriage slidably supported on a supporting base for supporting users and having a number of massage members for massaging the users. This device also uses a carriage to move the massage rollers up and down the back of the person using the device. It cannot be conveniently tipped and does not incorporate the unique massage rollers with replaceable outer sleeves.

None of these previous efforts, however, provides the benefits attendant with the Combination Exercise-Massage Unit. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of the Combination Exercise-Massage Unit in detail it is to be understood that the design is not limited in its application to the details of construction and to the arrangement, of the components set forth in the following description or illustrated in the drawings. The Combination Exercise-Massage Unit is capable of other embodiments and of being practiced and carried out in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application.

SUMMARY OF THE INVENTION

The principal advantage of the Combination Exercise-Massage Unit is the unique combination of localized massage and exercise to relieve back pain.

Another advantage is the Combination Exercise-Massage Unit is a manual device that requires no electrical connections.

Another advantage of the Combination Exercise-Massage Unit is that it can be easily adjusted to the size of the person using the device.

Another advantage of the Combination Exercise-Massage Unit is that it has a variety of different configurations of interchangeable massage roller sleeves.

Another advantage is some of the sets of interchangeable roller sleeves are configured to massage different areas of the back while other sets have a uniform configuration.

Another advantage is some of the sets of interchangeable roller sleeves can be made of varying materials with different hardness's or durometer, thereby achieving a heavier or lighter feeling of massage by varying the hardness or softness of the rollers.

Another advantage of the Combination Exercise-Massage Unit is exercising in the lying down position with the feet above the level of the heart increases the blood circulation, especially in the area of the back and legs.

And, still another advantage is, by being in a lying position with the feet above the level of the heart, the leg motion serves as a motor to squeeze excessive fluids from the legs back to the heart, helping to reduce lower leg edema or varicose veins in the legs.

Yet another advantage of the Combination Exercise-Massage Unit is by tipping the unit, or adjusting the number of weights, different leg pressures can be achieved, and by increasing the resistance it will allow the user's body to build up more muscle strength in the legs and burn more body calories.

Another advantage of the Combination Exercise-Massage Unit is by tipping the unit, minimizing the body weight against the rollers, it will achieve a lighter feeling massage, and by adjusting the amount of weights utilized will allow the rollers to move fast or slow.

Another advantage is a person having back pain can tip the unit minimizing body weight against the lower back area and achieving a stronger feeling of massage on the middle back and shoulders, to achieve a heavier feeling massage in those areas, or by maintaining the horizontal position, minimizing the body weight on the shoulder area and thereby achieving a stronger massage feeling on the lower back area.

Another advantage of the Combination Exercise-Massage Unit is some people prefer to be in a position with their head elevated to use this type of device such as those individuals having problems with acid reflux.

A further advantage of the Combination Exercise-Massage Unit is to provide a back stimulation unit that contributes to the rehabilitation of the back by strengthening the supportive muscles.

Another advantage of the Combination Exercise-Massage Unit is to provide a back stimulation unit that will have a smooth operation, while having a means for increasing resistance.

These together with other advantages of the Combination Exercise-Massage Unit, along with the various features of novelty, which characterize the design, are pointed out with particularity in the claims annexed to and forming a part of this disclosure. For a better understanding of the Combination Exercise-Massage Unit, its operating advantages and the specific objects attained by its uses, reference should be made to the accompanying drawings and descriptive matter in which there are illustrated preferred embodiments of the Combination Exercise-Massage Unit. There has thus been outlined, rather broadly, the more important features of the design in order that the detailed description thereof that follows may be better understood, and in order that the present contribution to the art may be better appreciated. There are additional features of the Combination Exercise-Massage Unit that will be described hereinafter and which will form the subject matter of the claims appended hereto.

The Combination Exercise-Massage Unit consists of a base platform with enclosed weight enclosure at one end and a pivoting bed assembly at the other. The bed assembly can easily be tipped by the means of pulling the handle at the foot of the bed assembly and releasing the spring loaded locking pins. Tipping the bed assembly can have the effect of increasing the weight lifted, reducing the pressure of the rollers on the back or relieving tension by elevating the head. The amount of weight can be adjusted by repositioning the weight adjusting pin.

When a person is performing the exercise-massage operation their feet are placed against the foot mats on the weight enclosure above the level of their heart. By repeatedly pushing with their legs their body is moved up and down the length of the bed assembly. A continuous belt covers a plurality of massage rollers that have replaceable outer sleeves with a variety of different configurations and softness. There is a translating framework that has an elevated head rest and two shoulder supports on either side. The person can hold the upright handles or the side support bars with the padded side members of the translating framework. A unique feature in the shoulder supports is that they are angled so that when the person pushes, their shoulders and back are pressed downward against the massage rollers. The two handles on the front of the weight enclosure aids the person when stepping on or off the unit. The translating framework can be adjusted in length to accommodate the height of the person using the unit by pulling a handle on the side to release the spring loaded locking pin and making the necessary adjustment.

The foregoing has outlined rather broadly the more pertinent and important features of the present application in order that the detailed description of the application that follows may be better understood so that the present contribution to the art may be more fully appreciated. Additional features of the design will be described hereinafter which form the subject of the claims of this disclosure. It should be appreciated by those skilled in the art that the conception and the disclosed specific embodiment may be readily utilized as a basis for modifying or designing other structures and methods for carrying out the same purposes of the present design. It should also be realized by those skilled in the art that such equivalent constructions and methods do not depart from the spirit and scope of this application as set forth in the appended claims.

BRIEF DESCRIPTION OF THE DRAWINGS

The accompanying drawings, which are incorporated in and form a part of this specification, illustrate embodiments of the Combination Exercise-Massage Unit and together with the description, serve to explain the principles of this application.

For a fuller understanding of the nature and advantages of the Combination Exercise-Massage Unit, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figure 1:
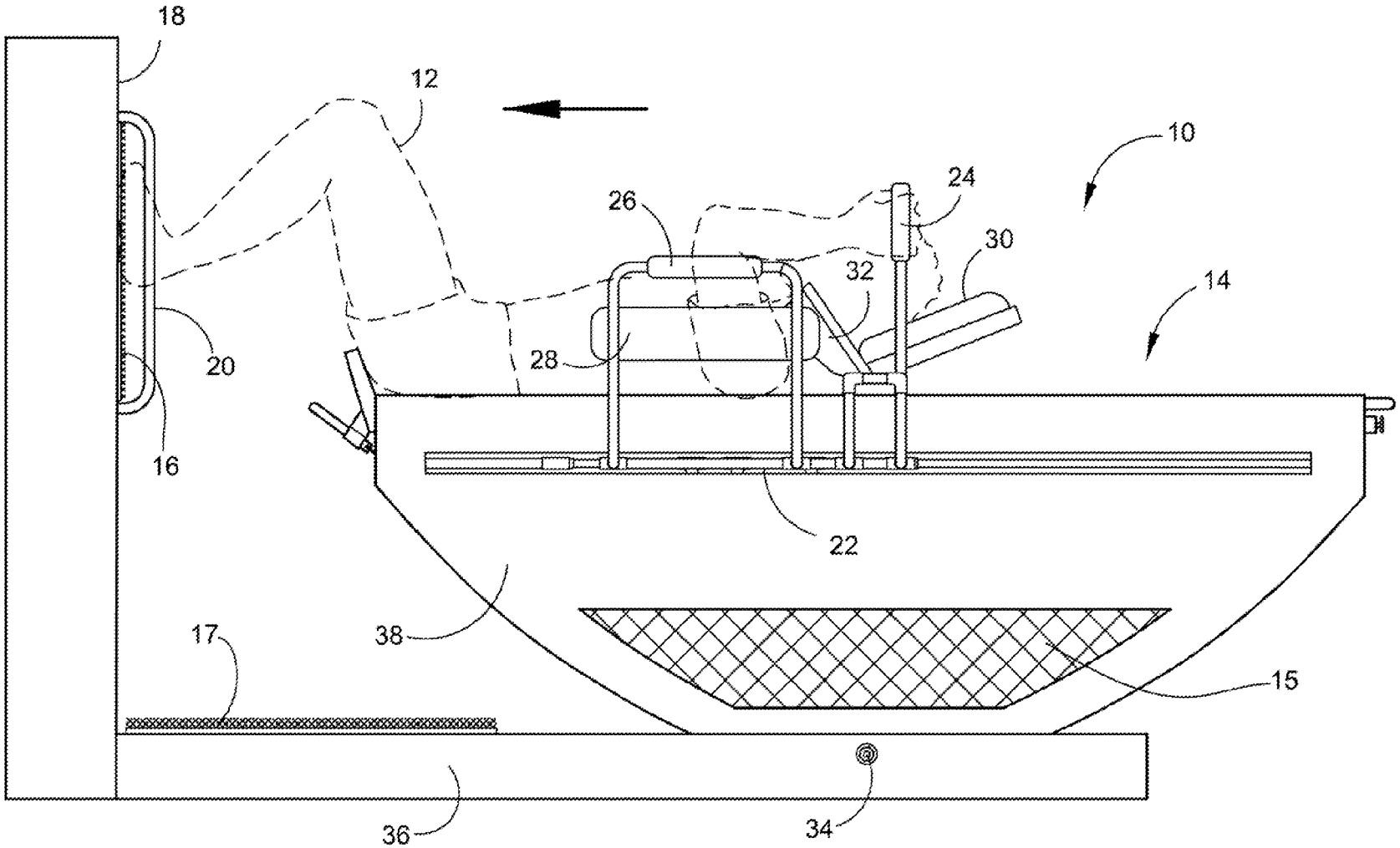
FIG. 1 depicts a side view of the Combination Exercise-Massage Unit in the horizontal position with a person in the compressed position.

Referring now to the drawings, wherein similar parts of the Combination Exercise-Massage Unit 10 are identified by like reference numerals, there is seen in FIG. 1 an elevation side view of the Combination Exercise-Massage Unit 10 in the horizontal position with a person 12 in the compressed state, resting on the bed assembly 14 with his feet against a rubberized or non-skid footpad 16 against the weight enclosure 18. The person 12 is lying between the two handles 20 of the translating frame assembly 22. The two handles 20 on the front of the weight enclosure 18 aid the person 12 when stepping on or off the unit. The person 12 is holding the up-right handles 24 with the option of holding the padded top of the side support bars 26. The side support bars 26 have additional padded side members 28. The person's 12 head is resting on the headrest 30 with his shoulders against the shoulder support 32. The Combination Exercise-Massage Unit 10 pivots on an axis through the mounting bolts 34 on each side, through the lower frame member 36 and adjacent to the left side 38 of the unit. The lower portion of the bed assembly 14 has an opening that is covered by a mesh screen or curtain 15.

Figure 2:
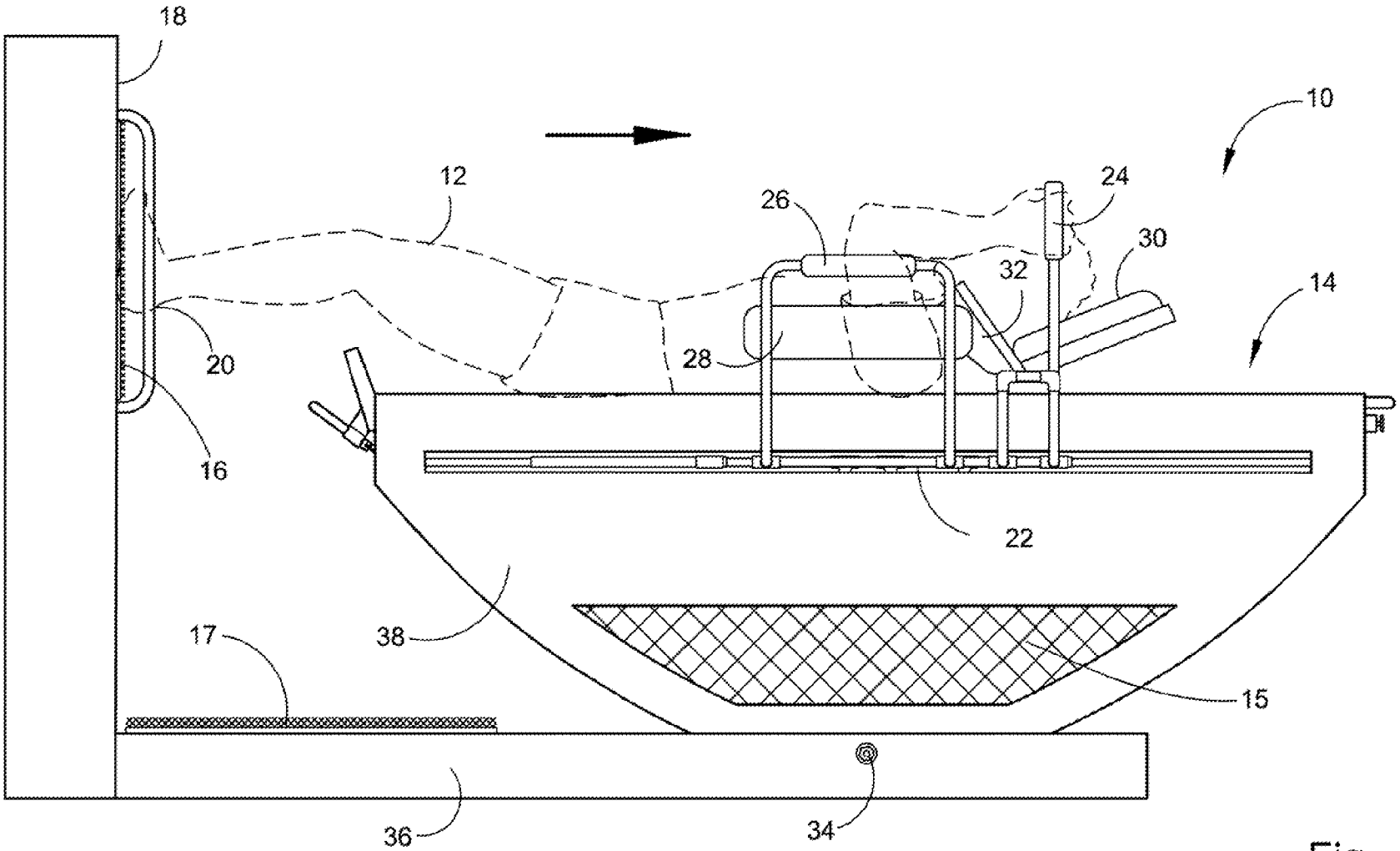
FIG. 2 depicts a side view of the Combination Exercise-Massage Unit in the horizontal position with a person in the extended position.

FIG. 2 depicts a side view of the Combination Exercise-Massage Unit 10 in the horizontal position with a person 12 on the translating frame assembly 22 in the extended position. An additional safety feature is the rubberized or non-skid floor mat 17 as shown in FIGS. 1-4. The handles 20 also prevent the user from accidentally placing his or her feet into the opening running down the center of the weight enclosure 18, as does the rubberized or non-skid footpad 16.

Figure 3:
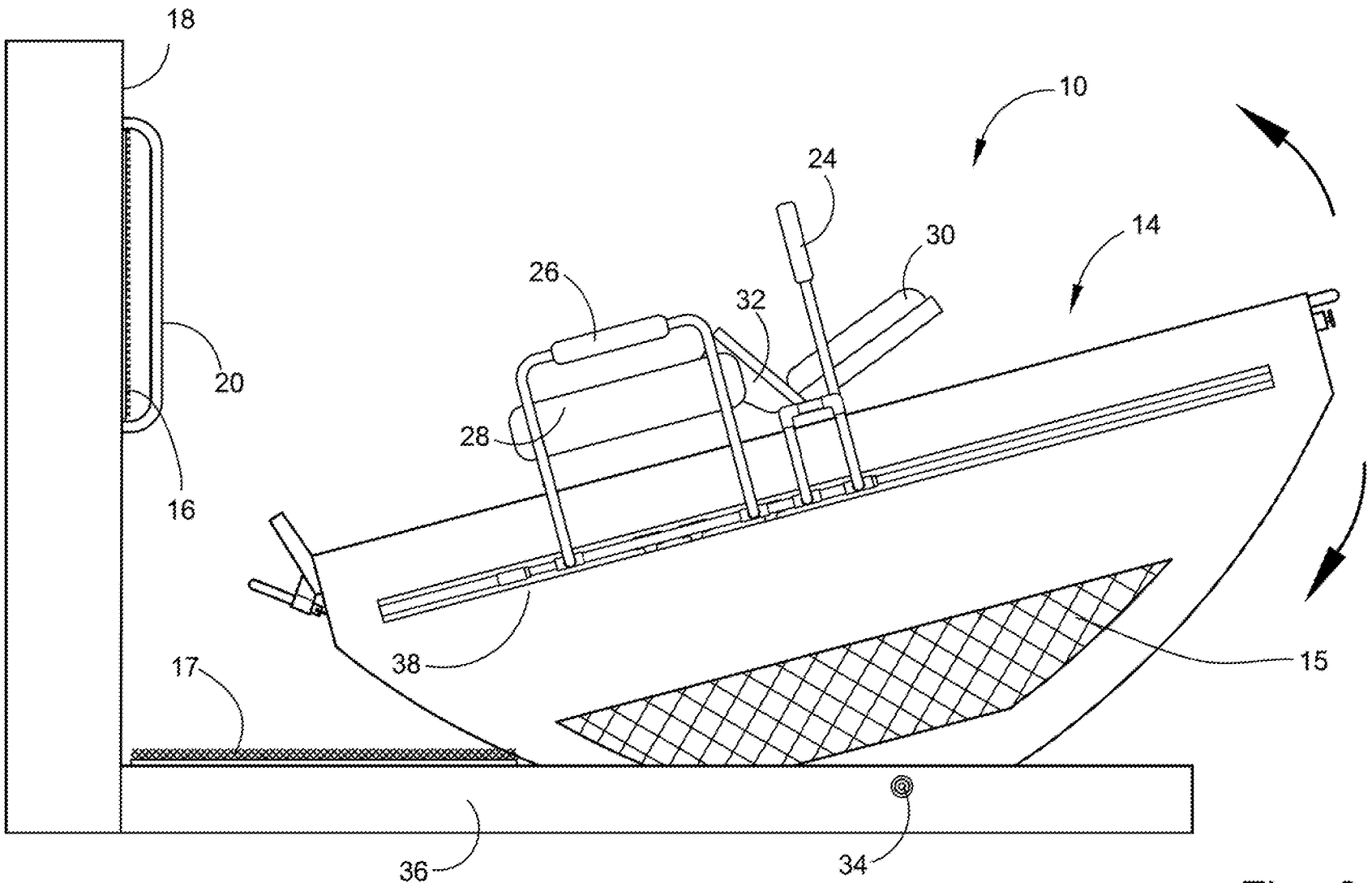
FIG. 3 depicts a side view of the Combination Exercise-Massage Unit with the bed assembly in the tipped position.

FIG. 3 depicts a side view of the Combination Exercise-Massage Unit 10 in the tipped position. The Combination Exercise-Massage Unit 10 can be adjusted in up or down tilt as shown by the arrows, then locked into the tipped position as explained in further detail in FIG. 4 below.

Figure 4:
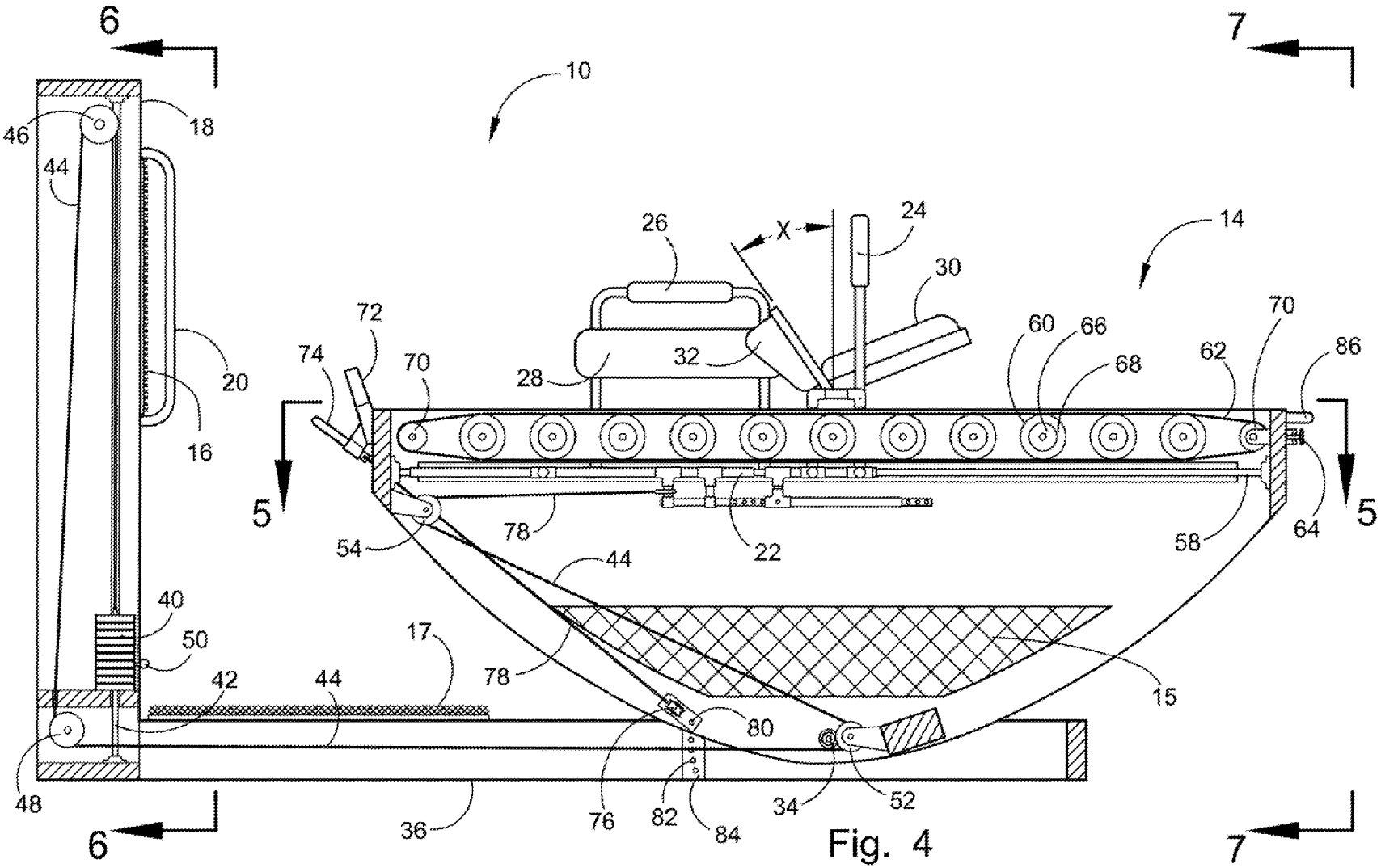
FIG. 4 depicts a cross section side view of the Combination Exercise-Massage Unit in the horizontal position.

FIG. 4 depicts a cross section side view of the Combination Exercise-Massage Unit 10 in the horizontal position exposing the internal components. The weight enclosure 18 consists of a series of conventional weights 40 being elevated up the weight rods 42 by the means of the weight cable 44 going over the upper weight enclosure pulley 46 and then down to the lower weight enclosure pulley 48. A weight adjustment pin 50 is used to adjust the desired amount weight to be used in the exercise portion of the activity. The two handles 20 support the person entering or leaving the unit. The weight cable 44 then extends through the lower frame member 36 to the bed assembly 14 where it connects to the lower bed assembly pulley 52 and then to the upper bed assembly pulley 54, it then connects to the rear of the translating frame 22. The translating frame 22 moves back and forth on three stationary rods 58 as the person 12 laying on it is moved over a plurality of massage rollers 60 by the means of a continuous belt 62. A continuous belt tightening apparatus 64 at the distal end of the bed assembly 14 is used to tighten the continuous belt 62 when it is required. The massage rollers 60 consist of a keyed roller shaft 66 with a variety of different replaceable outer sleeves 68. A plane roller shaft 70 is located at either end of the continuous belt 62. A seat member 72 is located at the distal end of the bed section 14 used to position the person 12 when they set on the unit. Adjacent to the seat member 72 is the tilting handle 74 where by pulling, a tilting cable 78 that extends on both sides of the bed assembly 14 to pulleys 76 where the tilting cables 78 cross to the opposite side releasing locking pins 80 and allowing the unit to be tilted to a variety of different positions by the means of holes 82 in indexing plates 84. An additional handle 86 is positioned at the opposite end for additional support during tipping of the unit. Noted in this view is the angle X of the shoulder support 32 that can be between 30 and 40 degrees, and exerts a downward pressure on the shoulders of the person 12 using the unit when they are pushing with their feet. This allows users of all sizes to adjust the shoulder support 32 angle X in order to operate the unit with maximum comfort and effectiveness.

Figure 5:
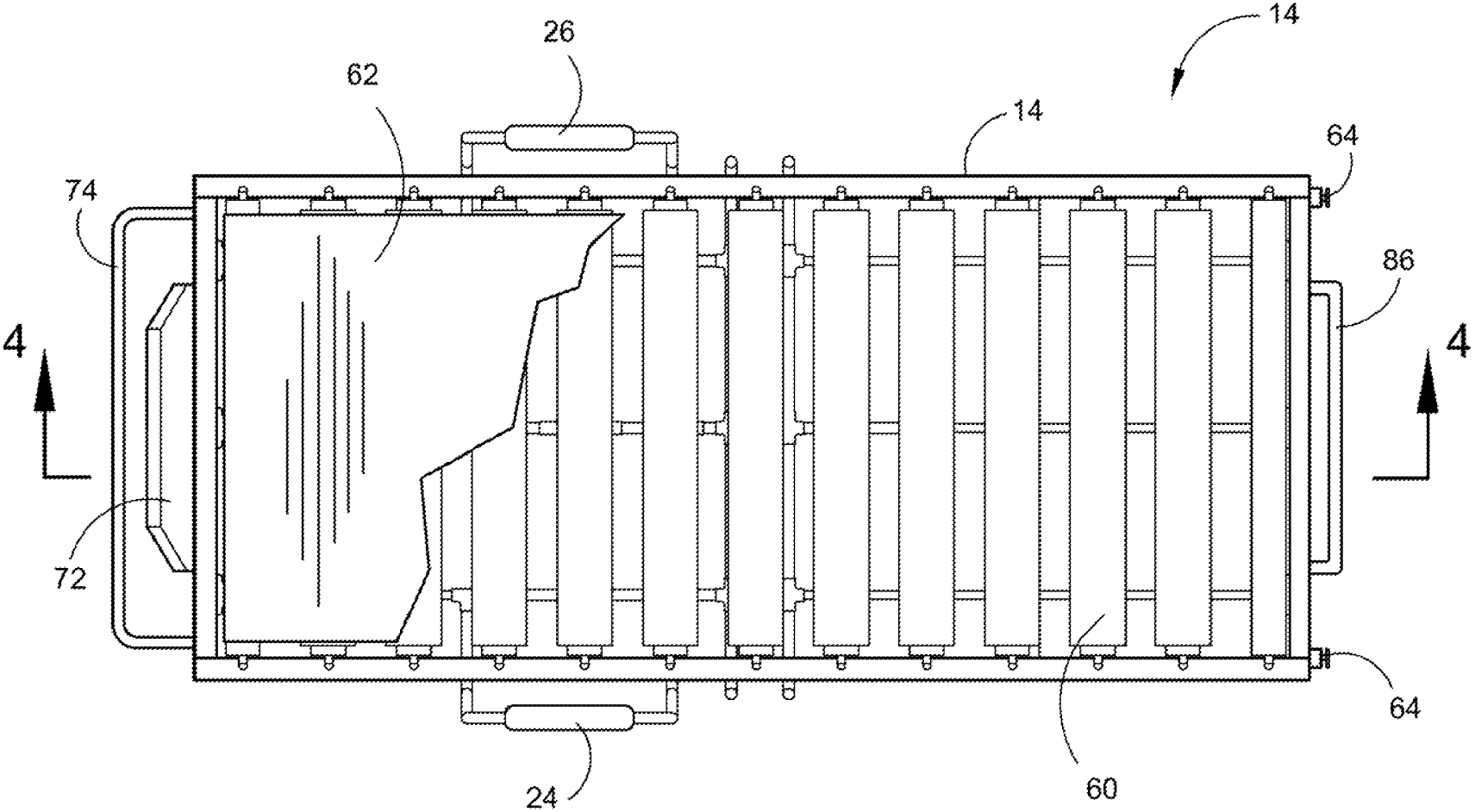
FIG. 5 depicts a top view of the of the bed assembly of the Combination Exercise-Massage Unit.

FIG. 5 depicts a top view of the of the bed assembly 14 of the Combination Exercise-Massage Unit 10 illustrating the location of the massage rollers 60 and the continuous belt 62.

Figure 6:
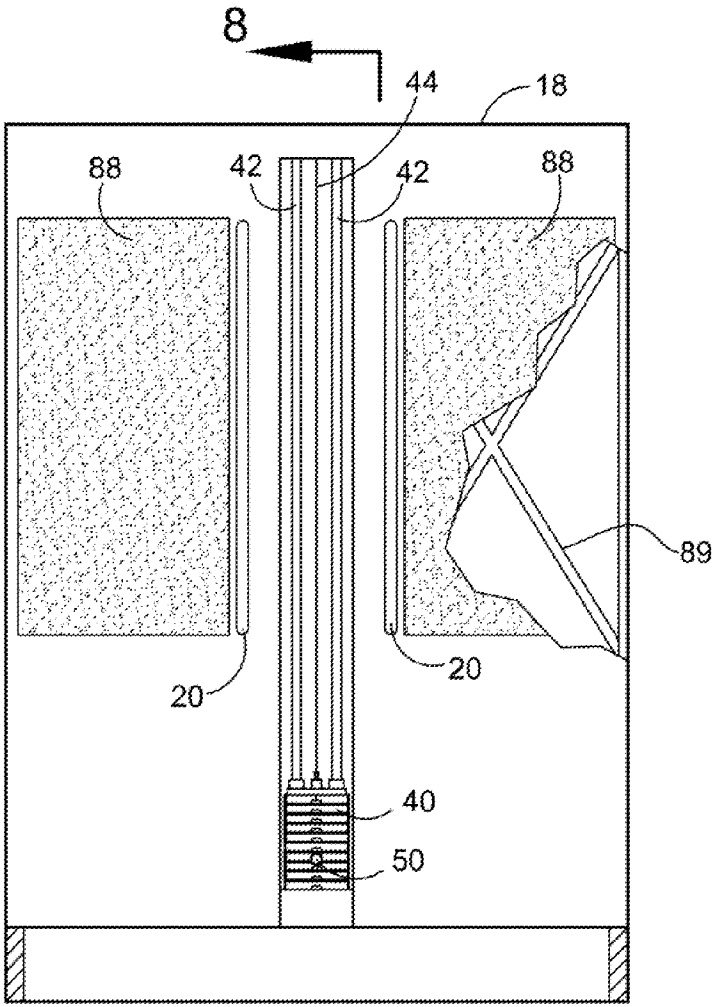
FIG. 6 depicts a partially cut-away end view of the weight enclosure omitting the bed assembly.

FIG. 6 depicts a partially cut-away end view of the weight enclosure 18 omitting the bed assembly 14 illustrating the location of the two foot mats 88 and the handles 20. Because a great deal of pressure could be placed upon the two foot mats 88 during operation, the frame of the weight enclosure 18 is reinforced with cross beams 89, as shown here in the partially cut-away view of the weight enclosure 18.

Figure 7:
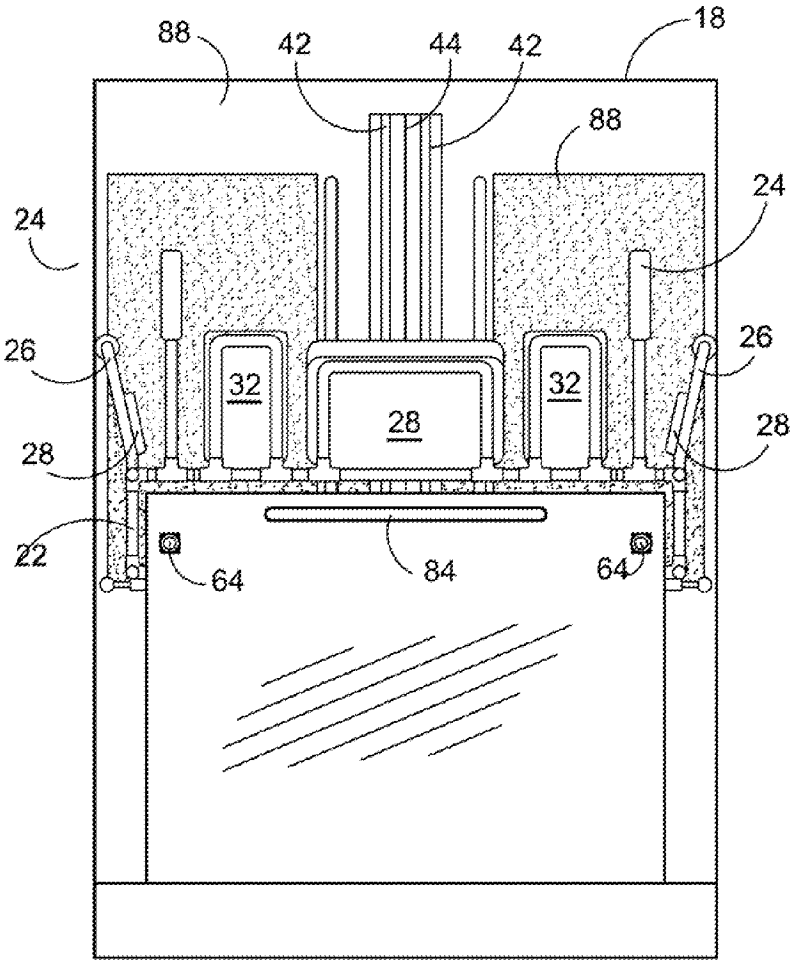
FIG. 7 depicts an end view of the Combination Exercise-Massage Unit with the bed assembly in the horizontal position.

FIG. 7 depicts an end view of the Combination Exercise-Massage Unit 10 with the bed assembly 14 in the horizontal position.

Figure 8:
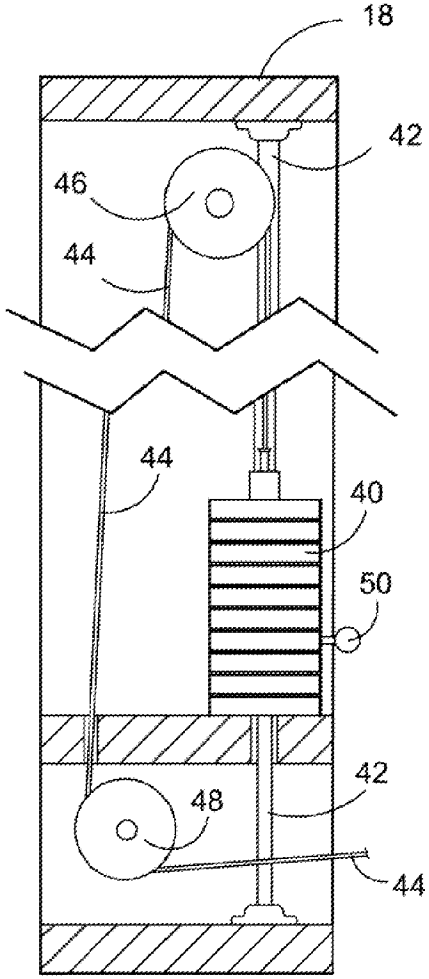
FIG. 8 depicts an enlarged cross section of the weight enclosure of the Combination Exercise-Massage Unit.

FIG. 8 depicts an enlarged cross section of the weight enclosure 18 of the Combination Exercise-Massage Unit 10 consisting of a series of conventional weights 40 being elevated up the weight rods 42 by the means of the weight cable 44 going over the upper weight enclosure pulley 46 and then down to the lower weight enclosure pulley 48. A weight adjustment pin 50 is used to adjust the desired amount weight to be used in the exercise portion of the activity.

Figure 9:
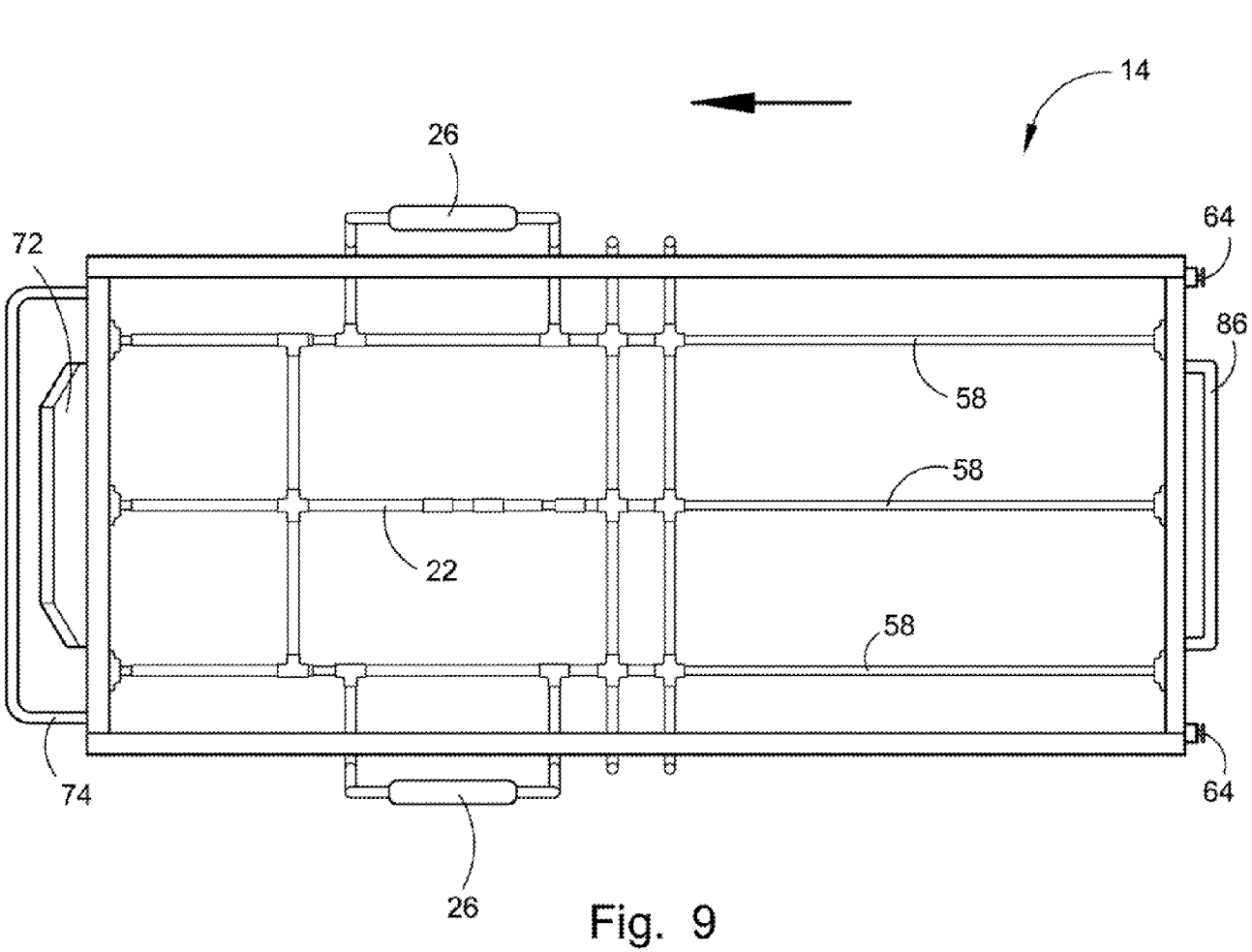
FIG. 9 depicts a top view of the bed assembly with the rollers removed and the translating frame in the lower position.
Figure 10:
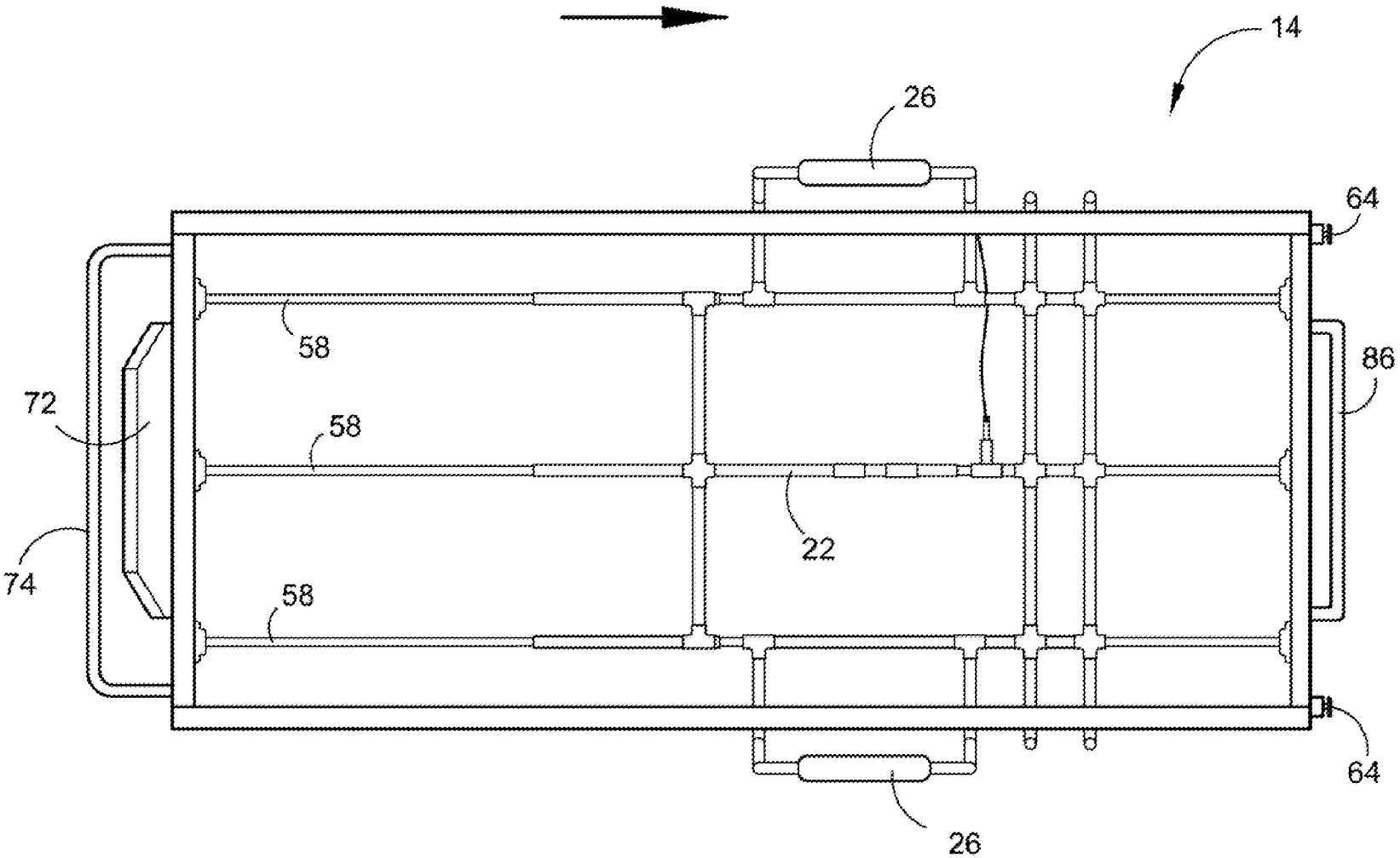
FIG. 10 depicts a top view of the bed assembly with the rollers removed and the translating frame in the upper position.

FIG. 9 depicts a top view of the bed assembly 14 with the massage rollers 60 removed and the translating frame 22 in the lower position illustrating the location of the three stationary rods 58. FIG. 10 depicts a top view of the bed assembly 14 with the massage rollers 60 removed and the translating frame 22 in the upper position.

Figure 11:
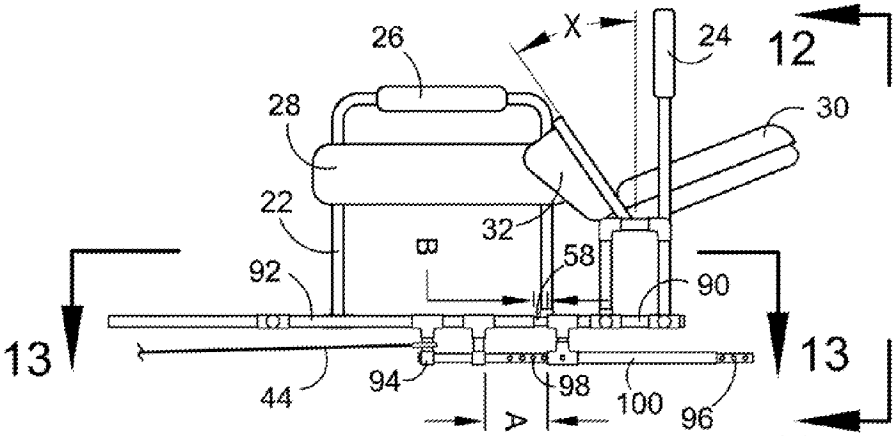
FIG. 11 depicts a side view of the translating frame in the compressed state.

FIG. 11 depicts a side view of the translating frame 22 in the compressed state composed of a forward section 90 and a rear section 92 that slide over the stationary rods 58. The forward section 90 and a rear section 92 of the translating frame 22 are adjustable in length for the size of the person 12 by the means of the adjustment bar mounting 94 attached to the center of the translating frame 22, with an adjustment bar 96 having a plurality of locking orifices 98 mounted to the rear section 92 of the translating frame 22 and a guide tube 100 mounted to the forward section 90 of the translating frame 22. Segment A is a portion of the adjustment bar 96 entering the supporting structure of the guide tube 100, while B is a segment of the central stationary rod 58. Again, noted in this view is the angle X of the shoulder support 32 that can be between 30 and 40 degrees, and exerts a downward pressure on the shoulders of the person using the unit when they are pushing with their feet. This allows users of all sizes to adjust the shoulder support 32 angle X in order to operate the unit with maximum comfort and effectiveness.

Figure 12:
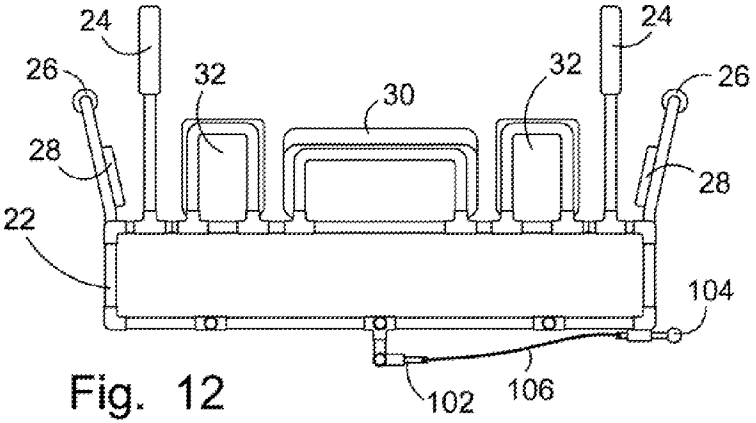
FIG. 12 depicts an end view of the translating frame.

FIG. 12 depicts an end view clarifying the configuration of the of the translating frame 22 and showing the location of the spring loaded locking pin 102 that engages in the locking orifices 98. The locking pin 102 is connected to a release handle 104 by the means of the locking pin cable 106.

Figure 14:
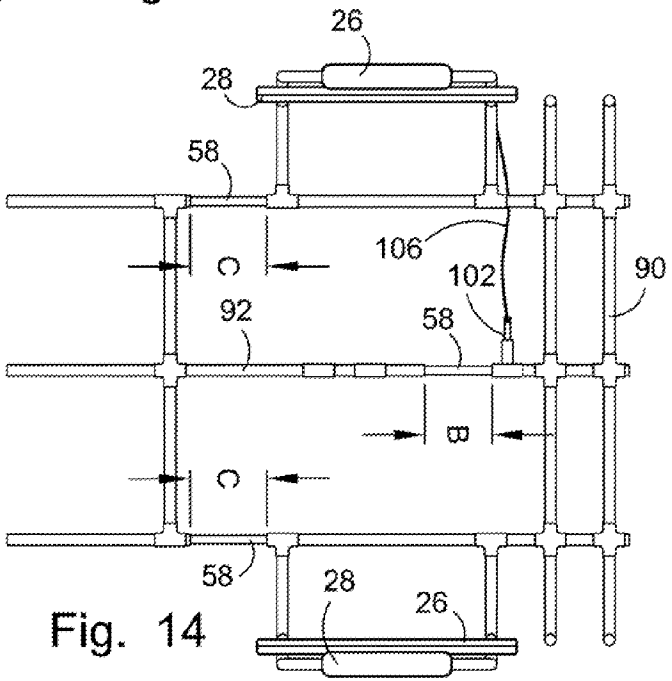
FIG. 14 depicts a top view of the translating frame in the extended state.
Figure 13:
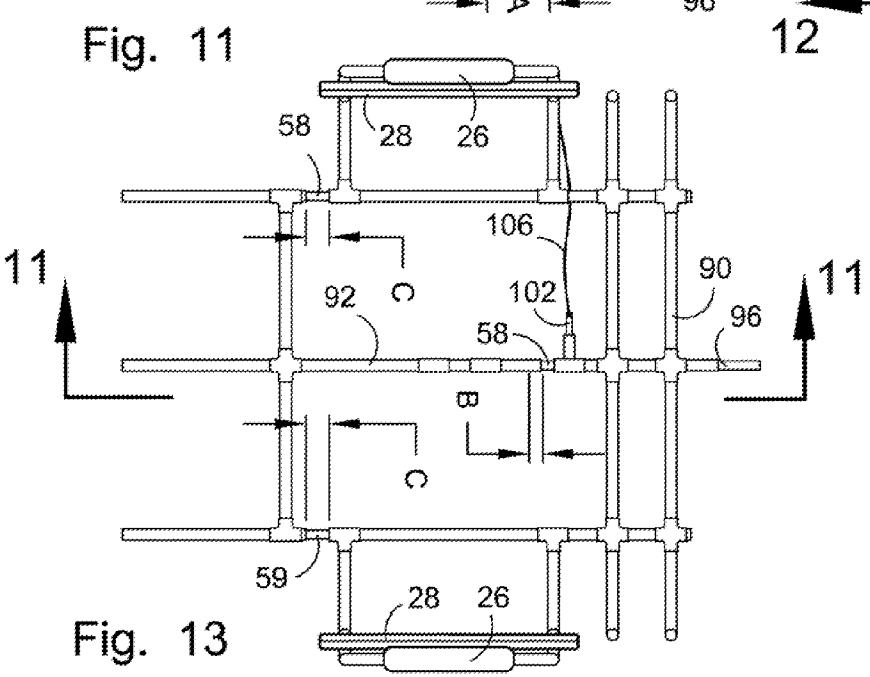
FIG. 13 depicts a top view of the translating frame in the compressed state.

FIG. 13 depicts a top view of the translating frame 22 in the compressed state illustrating the locations B and C where the stationary rods 58 are exposed. FIG. 14 depicts a top view of the translating frame 22 in the extended state further illustrating the extended length of the exposed stationary rods 58.

Figure 15:
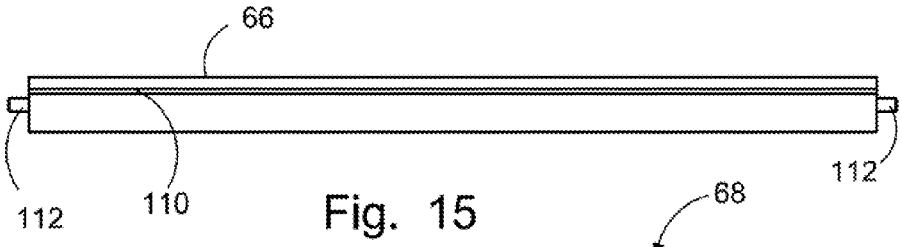
FIG. 15 depicts a side view of one of the keyed roller shaft.
Figure 16:
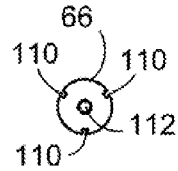
FIG. 16 depicts an end view of one of the keyed roller shaft.

FIG. 15 depicts a side view of one of the massage keyed roller shafts 66 having three keyways 110 running the entire length, pivoting on axles 112 at either end. FIG. 16 depicts an end view of one of the massage keyed roller shaft 66 clarifying the location of the three separate keyways 110.

Figure 17:
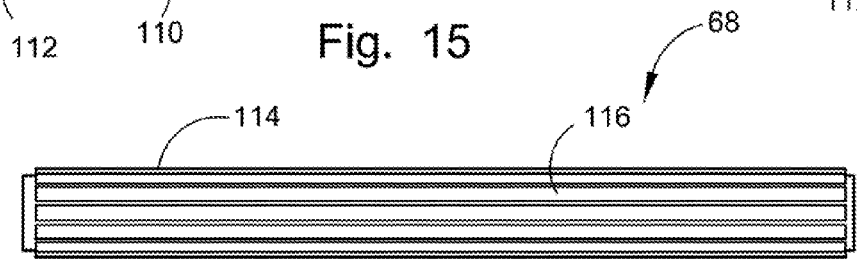
FIG. 17 depicts a side view of the first embodiment of the massage roller sleeve.
Figure 18:
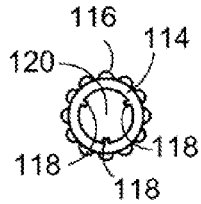
FIG. 18 depicts an end view of the first embodiment of the massage roller sleeve.

FIG. 17 depicts a side view of the replaceable outer sleeve 68 with the first embodiment being the massage roller sleeve 114 having a plurality of rod like segments 116 around its outer perimeter with three separate keys 118 running the full length of the interior cavity 120 matching the keyways 110 in the massage keyed roller shaft 66. The preferred embodiment of the massage roller sleeves 68 will all be made of a urethane or polymer material of a varying durometer, hardness or softness, and flexibility depending upon the desired effect of the massage. The replaceable outer sleeves 68 can be easily removed by loosening the belt tightening apparatus 64 and removing the massage roller 60. FIG. 18 depicts an end view of the first embodiment of the massage roller sleeve 114.

Figure 19:
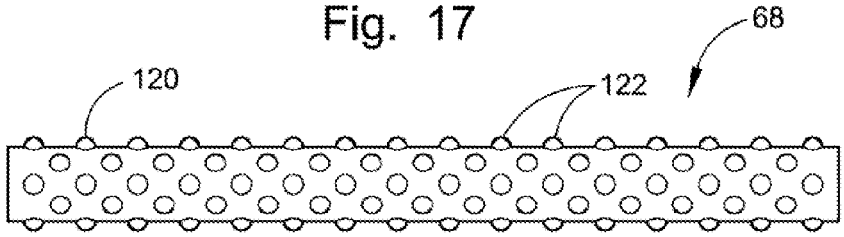
FIG. 19 depicts a side view of the second embodiment of the massage roller sleeve.
Figure 20:
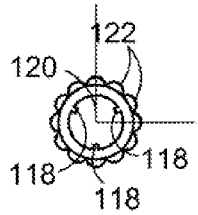
FIG. 20 depicts an end view of the second embodiment of the massage roller sleeve.

FIG. 19 depicts a side view of the replaceable outer sleeve 68 with the second embodiment being the massage roller sleeve 122 having series of alternating rows of spherical massage elements 124. FIG. 20 depicts an end view of the second embodiment of the massage roller sleeve 122 with three separate keys 114 running the full length of the interior cavity 120 matching the keyways 110 in the massage keyed roller shaft 66. FIG. 20 depicts an end view of the second embodiment of the massage roller sleeve 120.

Figure 21:
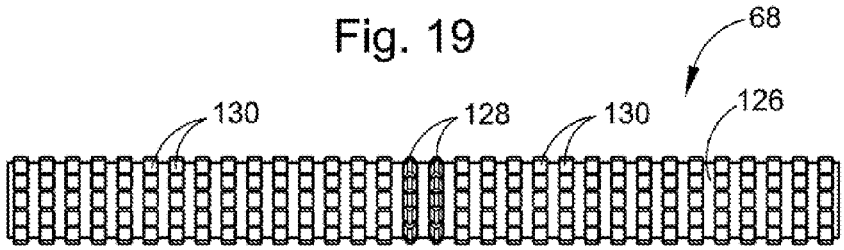
FIG. 21 depicts a side view of the third embodiment of the massage roller sleeve.
Figure 22:
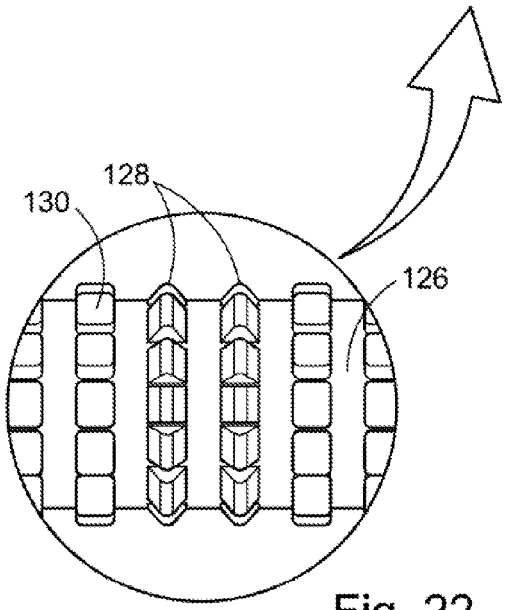
FIG. 22 depicts an enlarged view of the central section of the third embodiment of the massage roller sleeve.
Figure 23:
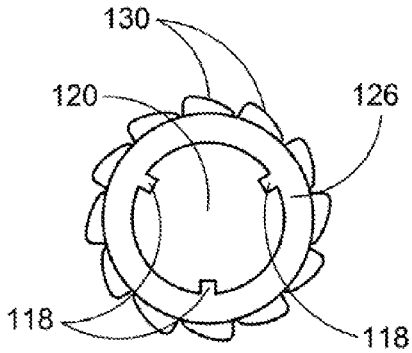
FIG. 23 depicts an end view of the third embodiment of the massage roller sleeve.

FIG. 21 depicts a side view of the replaceable outer sleeve 68 with the third embodiment being the massage roller sleeve 126 having a unique configuration where two or more rows of specially contoured massage elements 128 have been designed centrally located to work the area on each side of the spine while the rest of the massage elements 130 are configured to have a similarity to the shape of the thumb of a masseuse. FIG. 22 depicts an enlarged view of the central section of the third embodiment of the massage roller sleeve 126. It must be clearly understood that a wide variety of shapes, sizes and hardness of massage elements can be used and will fall within the scope of this application. FIG. 23 depicts an end view of the third embodiment of the massage roller sleeve 126 with three separate keys 118 running the full length of the interior cavity 120 matching the keyways 110 in the massage keyed roller shaft 66.

Figure 24:
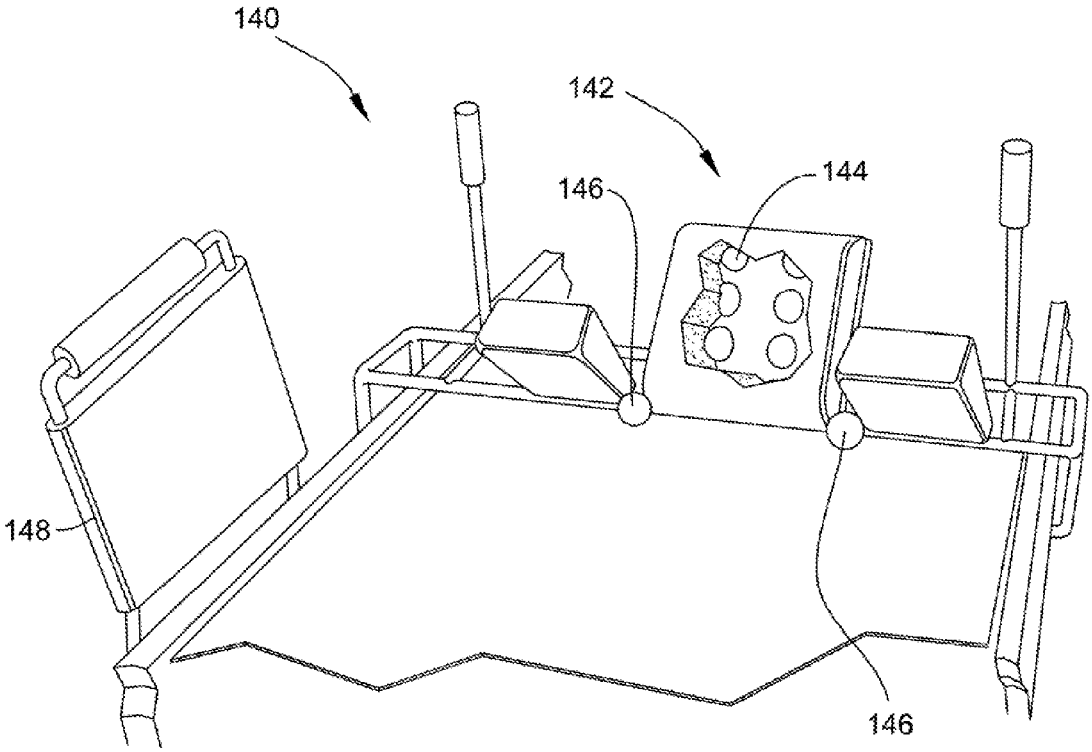
FIG. 24 depicts a partially cut-away perspective view of a deluxe version of the combination exercise-massage unit having the additional features of modified shoulder and head massage elements.

FIG. 24 depicts a partially cut-away perspective view of a deluxe version of the combination exercise-massage unit 140 having the additional features of modified shoulder and head massage elements. The headrest 142 consists of soft foam in which a firmer plurality of head and neck massage elements 144 are positioned in a varying pattern. Added optional shoulder point massage elements 146 are positioned optimally to massage the user's trapezius muscle associated with the neck and shoulders. The deluxe model 140 may also include larger padded side members 148 for greater elbow support and added comfort.

Figure 25:
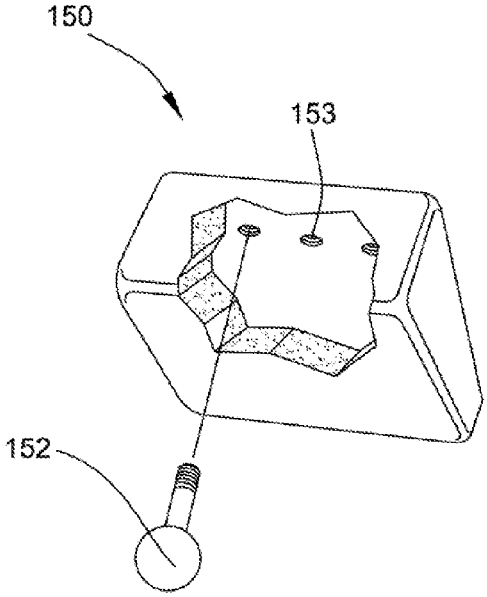
FIG. 25 depicts a partially cut-away perspective view of an optional shoulder support unit having a position adjustable shoulder massage element.

FIG. 25 depicts a partially cut-away perspective view of an optional shoulder support unit 150 having a position adjustable shoulder massage element 152. Here, it is illustrated as a three position adjustment, small, medium and large in which the optional shoulder massage element 152 has a male threaded end which threads into the female threads 153 located in the back frame of the shoulder support unit 150. One or more of these optional shoulder massage elements 152 may be used at the same time. These adjustable shoulder massage elements may be constructed of varying softness or hardness. Other attachment means may also be employed.

Figure 26:
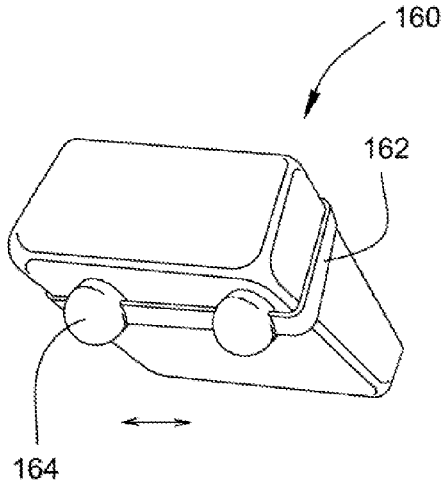
FIG. 26 depicts a perspective view of another optional shoulder support unit having a removable position adjustable multiple shoulder massage element.

FIG. 26 depicts a perspective view of another optional shoulder support unit 160 having a removable position adjustable multiple shoulder massage element. The optional shoulder massage elements 164 are slidably attached to an adjustable strap 162 and are readily attached or removed and slid into a desired position for optimal massage effect. One or more of these optional shoulder massage elements 164 and adjustable straps 162 may be used at the same time. These adjustable shoulder massage elements may be constructed of varying softness or hardness. Other attachment means may also be employed.

The Combination Exercise-Massage Unit 10 shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing a Combination Exercise-Massage Unit 10 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A combination exercise and massage device comprising:

(a) a lower frame member having a bed assembly and a weight enclosure attached thereto;

(b) said bed assembly having a continuous belt, a plurality of massage rollers and a translating frame assembly including a headrest and shoulder support units;

(c) said weight enclosure including a plurality of weights attached to said translating frame assembly via a weight cable; and (d) wherein said bed assembly is pivotally mounted to said frame member and includes a locking mechanism such that said bed assembly is capable of tilting to adjust the desired angle, and locking into place in that desired angle for operation;

whereby a user lies on Said bed assembly with head on said headrest, shoulders on said shoulder supports and feet against said weight enclosure, and bends then extends the legs to exercise and simultaneously obtain a back massage.

2. The combination exercise and massage device according to claim 1, wherein said translating frame assembly further includes an adjustment bar and locking mechanism such that said translating frame assembly is user adjustable for the size and height of different users.

3. The combination exercise and massage device according to claim 1, wherein said plurality of massage rollers further include a keyed roller shaft and a variable replaceable outer sleeve.

4. The combination exercise and massage device according to claim 3, wherein said variable replaceable outer sleeves include numerous varied massage elements, and further wherein said massage elements are constructed with materials of varying softness or hardness such that a user may combine massage elements to obtain a desired massage effect.

5. The combination exercise and massage device according to claim 1, wherein said weight enclosure includes handles and rubberized or non-skid foot mats.

6. The combination exercise and massage device according to claim 1, wherein said weight enclosure further includes a weight adjustment pin whereby said plurality of weights is user adjustable for a desired level of exercise and massage effect.

7. The combination exercise and massage device according to claim 1, wherein said bed assembly further includes one or more plain rollers in communication with a belt tightening apparatus for belt tensioning.

8. The combination exercise and massage device according to claim 1, wherein said translating frame assembly further includes padded side members.

9. The combination exercise and massage device according to claim 1, wherein said translating frame assembly further includes optional massage elements located in the headrest and shoulder supports.

10. The combination exercise and massage device according to claim 9, wherein said optional massage elements located in the headrest and shoulder supports are user adjustable for size and softness or hardness.

11. A method for making a combination exercise and massage device, comprising tile steps of:

(a) providing a lower frame member having a bed assembly and a weight enclosure attached thereto;

(b) providing said bed assembly having a continuous belt, a plurality of massage rollers and a translating frame assembly including a headrest and shoulder support units;

(c) providing said weight enclosure including a plurality of weights attached to said translating frame assembly via a weight cable;

(d) pivotally mounted said bed assembly to said frame member and providing a locking mechanism integrated within said bed assembly;

(e) tilting said bed assembly to adjust the desired angle; and (f) locking said bed assembly into place in that desired angle for operation;

whereby a user lies on said bed assembly with head on said headrest, shoulders on said shoulder supports and feet against said weight enclosure, and bends then extends the legs to exercise and simultaneously obtain a back massage.

12. The method of making a combination exercise and massage device according to claim 11, wherein said translating frame assembly includes an adjustment bar and locking mechanism such that said translating frame assembly is user adjustable for the size and height of different users.

13. The method of making a combination exercise and massage device according to claim 11, wherein said plurality of massage rollers further include a keyed roller shaft and a variable replaceable outer sleeve.

14. The method of making a combination exercise and massage device according to claim 13, wherein said Variable replaceable outer sleeves include numerous varied massage elements, and further wherein said massage elements are constructed with materials of varying softness or hardness such that a user may combine massage elements to obtain a desired massage effect.

15. The method of making a combination exercise and massage device according to claim 11, wherein said weight enclosure includes handles and rubberized or non-skid foot mats.

16. The method of making a combination exercise and massage device according to claim 11, further includes a weight adjustment pin whereby said plurality of weights is user adjustable for a desired level of exercise and massage effect.

17. The method of making a combination exercise and massage device according to claim 11, wherein said bed assembly further includes one or more plain rollers in communication with a belt tightening apparatus for belt tensioning.

18. The method of making a combination exercise and massage device according to claim 11, wherein said translating frame assembly further includes padded side members.

19. The method of making a combination exercise and massage device according to claim 11, wherein said translating frame assembly further includes optional massage elements located in the headrest and shoulder supports.

20. The method of making a combination exercise and massage device according to claim 19, wherein said optional massage elements located in the headrest and shoulder supports are user adjustable for size and softness or hardness.

* * * * *